US006129230A

United States Patent [19]

Turner et al.

[11] Patent Number: 6,129,230

[45] Date of Patent: Oct. 10, 2000

[54] END CLOSURE WITH IMPROVED NON-DETACHABLE OPENING PANEL

[75] Inventors: Timothy L. Turner, Cary; Randy G. Forrest, Park Ridge, both of Ill.

[73] Assignee: American National Can Company, Chicago, Ill.

[21] Appl. No.: 09/215,897

[22] Filed: Dec. 18, 1998

[51] Int. Cl.[7] ..... B65D 17/34

[52] U.S. Cl. ..... 220/269

[58] Field of Search ..... 220/269

[56] References Cited

U.S. PATENT DOCUMENTS

| | | | |
|---|---|---|---|
| 3,952,912 | 4/1976 | Perry . | |
| 3,967,752 | 7/1976 | Cudzik . | |
| 4,015,744 | 4/1977 | Brown . | |
| 4,024,981 | 5/1977 | Brown . | |
| 4,084,721 | 4/1978 | Perry | 220/269 |
| 4,184,607 | 1/1980 | Potts . | |
| 4,363,419 | 12/1982 | Walz, Sr. . | |
| 4,402,421 | 9/1983 | Ruemer, Jr. . | |
| 4,901,880 | 2/1990 | Tatham et al. . | |
| 5,011,037 | 4/1991 | Moen et al. . | |
| 5,064,087 | 11/1991 | Koch . | |
| 5,219,257 | 6/1993 | Koch . | |
| 5,307,947 | 5/1994 | Moen et al. . | |
| 5,375,729 | 12/1994 | Schubert . | |
| 5,405,039 | 4/1995 | Komura . | |
| 5,555,992 | 9/1996 | Sedgeley . | |
| 5,692,636 | 12/1997 | Schubert . | |
| 5,738,237 | 4/1998 | McEldowney . | |
| 5,860,553 | 11/1999 | Schubert | 220/271 |

FOREIGN PATENT DOCUMENTS

| | | | |
|---|---|---|---|
| 1-308744 | 12/1989 | Japan . | |
| 8-244769 | 9/1996 | Japan | 220/269 |

*Primary Examiner*—Stephen K. Cronin
*Attorney, Agent, or Firm*—Wallenstein & Wagner, Ltd.

[57] ABSTRACT

A stay-on-tab container end having a panel wall with a tab attached by a rivet and having a tear panel. The tear panel being defined by a frangible score with a first end and a second end and a non-frangible hinge segment. A second groove is formed in the panel wall with a tail portion extending from the tear panel through the hinge segment. The second groove tail portion has a reduced residual differential compared to the frangible score residual. Also the tail portion includes a curved terminal end that partially surrounds the second end of the score.

23 Claims, 3 Drawing Sheets

END CLOSURE WITH IMPROVED NON-DETACHABLE OPENING PANEL

DESCRIPTION

1. Technical Field

The present invention relates to end closures for two-piece beer and beverage metal containers having a non-detachable operating panel. More specifically, the present invention relates to improved characteristics of a frangible panel of the end with integral attachment of the frangible panel to prevent full detachment of the frangible panel.

2. Background of the Invention

Common end closures for beer and beverage containers have a central panel that has a frangible panel (sometimes called a "tear panel." "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage-container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These types of "stay-on-tab" ecology container ends have been used for many years, with a retained tab and a tear panel of various different shapes and sizes. Throughout the use of such ends, manufacturers have sought to save the expense of the metal by down-gauging the metal of the ends and the tabs. However, because ends are used for containers with pressurized contents and are sometimes subject to pasteurization, there are conditions causing great stresses to the components of the end during pasteurization, transit and during opening by a user. These conditions limit the available gauge reduction of the end metal, and make it difficult to alter design characteristics of the end, such as by reducing metal gauge or the thickness of the metal residual in the score defining the tear panel.

Further, abuse during shipping, retail stocking and vending, due to rough handling of the filled containers, often causes problems with openability of the end. As an example of a problematic condition caused by handling abuse is the poor openability of a buckled container end. Due to dropping or abusive handling of filled containers, excessive pressure loads on regions of the end may cause a buckle of the end material. Such abuse, typically caused by dropping an upright container that is filled with carbonated fluid, results in a buckled end panel that deforms to form a bulge of metal of the panel.

The possibility of such buckling is a prevalent concern due to down-gauging of the end material, pressurization of the container, pasteurizing filled containers, environmental conditions such as excessive heat, and rough handling of pallets or cases of filled containers. In a metal container end, the buckle appears as a deformation or bulge of the metal in a region of the end panel, a condition that adversely effects the users ability to open the end. Due to the geometry of the container and the ecology end panel, buckling of the end frequently is noticeable as a bulge of the end with a buckle in the 5:00 to 7:00 range of the end (with the middle of the tear panel positioned at 6:00). This type of buckled container end very often results in opening failure and resulting problems of a user trying to open the end.

Such a buckled end usually cannot be opened properly by the user. Instead, when the user lifts the tab and applies pressure on the tear panel with the tab nose, the score fractures at the wrong locations at the wrong time, usually resulting in a dramatic loss in leverage of the tab for opening the panel. In this situation, the tab is actuated against the tear panel by lifting the finger pull end of the tab, but the tab nose passes beyond the proximal peripheral edge of the tear panel, a condition often called "tuck under" of the tab.

The tab that tucks under is, therefore, fully lifted by the user, though the tear panel is still not fully opened. In this situation, the tear panel remains attaches by a segment of the score usually at about the 5:00 to 11:00 of the tear panel (defined with the tab nose being at about the 12:00 region of the tear panel). When this condition occurs, the user often tries to open the tear panel with something other than the tab, often by applying force by an object or the user's finger. However, such attempts at completing the opening sequence of the tear panel often causes fracture of the hinge of the tear panel, causing the tear panel to open entirely and become detached from the remainder of the end. When the user applies such force, a common result is for the hinge-line region of the metal, the non-scored fragment of metal that is intended to not fracture and to retain the tear panel, fails by fracturing along a non-specific tear of the metal away from the score. As a result, the tear panel is fully separated from the remainder of the end panel, and is usually pushed into the container. The fully detached tear panel then becomes a choking hazard or is otherwise a nuisance to the user and a potential pollutant. Therefore, there is a need for an end having design characteristics that prevents separation of the tear panel during user manipulation of ends with opening failure.

Further, with the more recent popular use of large-open ends, such problems with buckled ends is potentially greater. Because of the enlarged size and the shape of the opening panel (or tear panel), the score in certain regions of the large-open tear panel are more difficult to open by the tab leveraging against the tear panel. This is especially true for the region of the score which is in the 5:00 to 6:00 clock position. Therefore, large-opening ends may be difficult to open even when there is no noticeable sign of damage or buckle. Because of the additional force that may be required to open the large-opening tear panel with a tab, there may be more likelihood for non-specific tear of the metal away from the score. Also, because of the difficulty in opening the large-opening end, there is an increase in potential opening failure that results in "tuck tinder" of the tab. This type of opening failure also may result from the user opening the container too rapidly, not permitting proper venting of pressure from the container.

Because of these conditions, and the problem of potential tuck under of the tab and subsequent detachment of the tear panel when a buckled end results in opening failure and the user manipulates the end to open it, there is a need for an improved end structure that prevents or inhibits the total removal of the tear panel in the situation of an opening failure.

SUMMARY OF THE INVENTION

It is an object of the present invention to provide an end closure for a container having a circumferential sidewall and a peripheral seaming edge adapted to be integrally connected to the sidewall. The end has a central panel wall with a means for opening a frangible panel segment of the panel wall and a rivet in the central panel adapted to integrally attach a tab lever having a nose portion overlying at least a vent region of the frangible panel segment and a lift end opposite said nose. A score groove is formed in the central panel wall to define an outer perimeter of the frangible panel. The score groove has a first end adjacent the vent region and a second end joined to the first end by a curvilinear segment of the score groove, whereby the first end and the second end is separated by a generally linear hinge segment of the central panel wall. The hinge segment is non-frangible to integrally connect the frangible panel segment to an adjacent area of the panel. A second groove is formed in the end, having a tail portion passing from the frangible panel through the hinge segment and extending into the adjacent area of the central panel.

It is also an object of the present invention to provide such an end member wherein the second groove has a curvilinear segment generally parallel an extent of the score groove. The invention further provides an end member in which the score groove and the second groove together form a double scoreline, the double scoreline being separated at the second end of the score groove, such that the tail portion of the second groove is longer than the second end of the score groove.

It is another object of the present invention to provide such an end member whereby the score groove is a generally v-shaped recess having a score depth into the thickness of the central panel, and the second groove is also a generally v-shaped recess having a groove depth into the thickness of the central panel less than that of the score groove.

It is further an object of the invention to provide an end member having a curvilinear score groove with two ends separated by a hinge segment extending along a generally straight line between the two ends. A second groove is formed in the end, extending along a length that intersects the hinge segment generally transverse to the generally straight line between the two ends of the score groove.

It its yet another object of the present invention to provide an ecology end having a frangible panel with an outer score and an inner anti-fracture score, wherein the anti-fracture score has a tail portion that passes through the hinge region of the frangible tear panel. It is an object of the invention to provide an anti-fracture score that extends beyond the score groove to at least partially surround the end of the score groove.

It is further an object of the present invention to provide an ecology stay-on-tab end having a frangible panel defined by a score and first hinge region between a first and second end of the score groove, and having a second hinge region passing between a second groove and the second end of the score groove.

DETAILED DESCRIPTION

Figure 1:
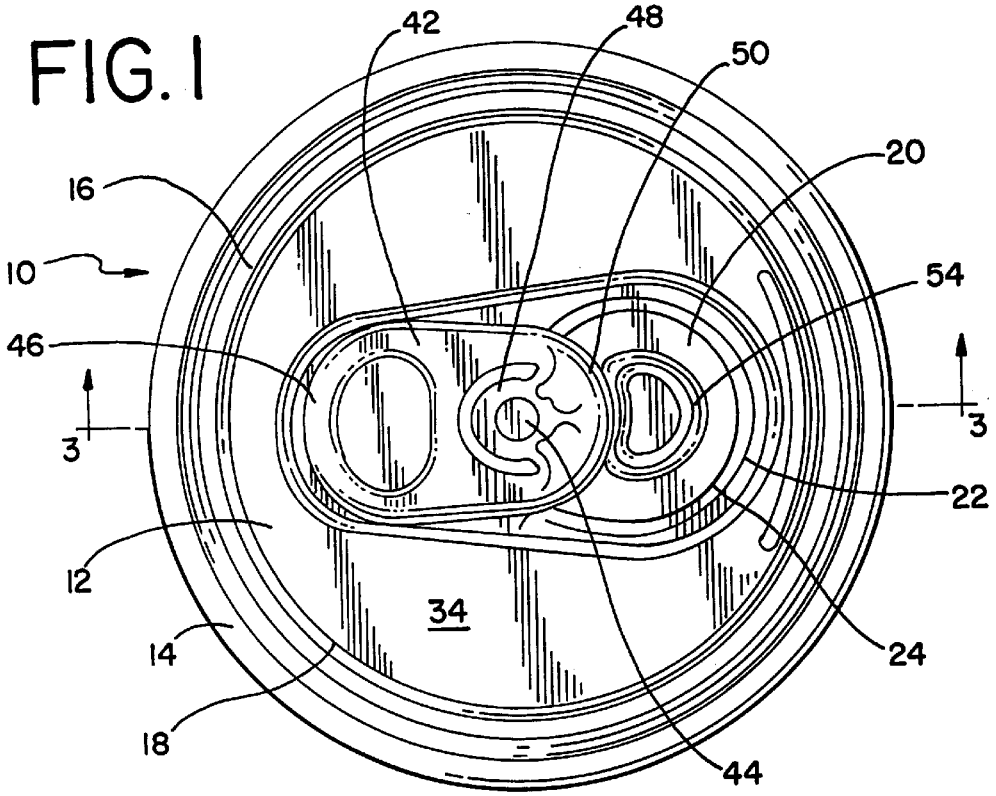
FIG. 1 is a plan view of the upper side an end closure of one embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved opening characteristics, having structure adapted to prevent detachment of the tear panel, which potentially results from a user forcing open a damaged end with opening failure. Essentially, the present invention provides a score groove inward from the main score to guard the main score when a fracture forms in the hinge of the opening panel of the end, as explained below.

Figure 2:
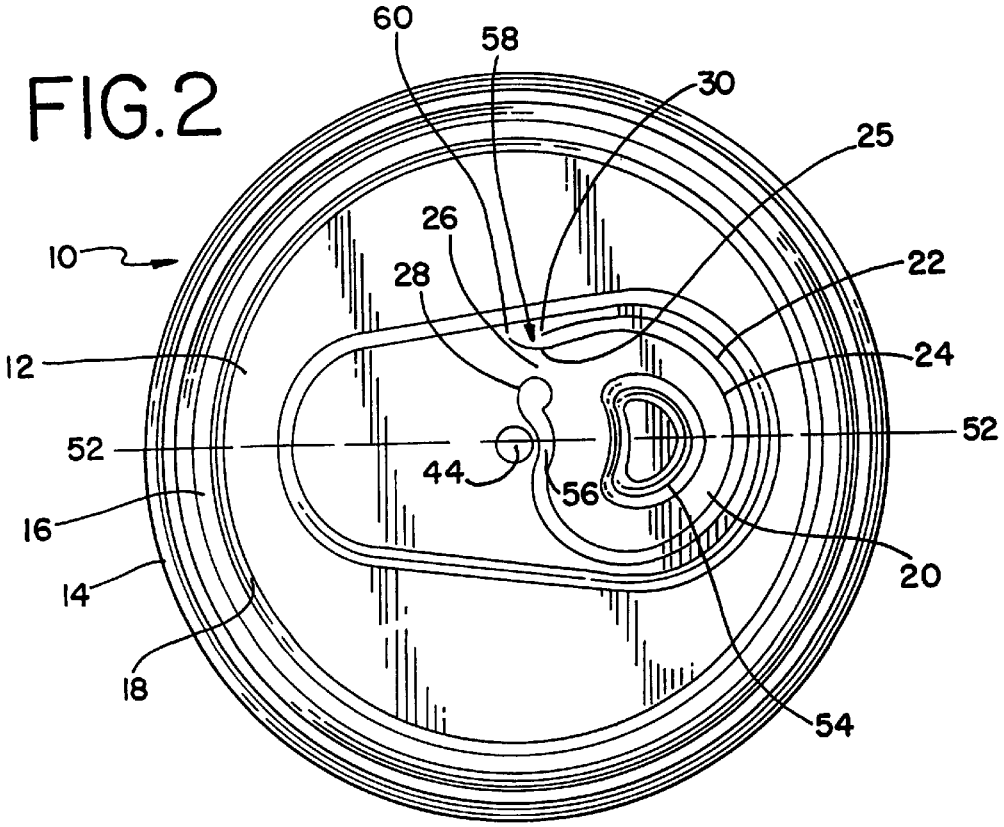
FIG. 2 is a plan view of the under side of the end of FIG. 1.
Figure 3:
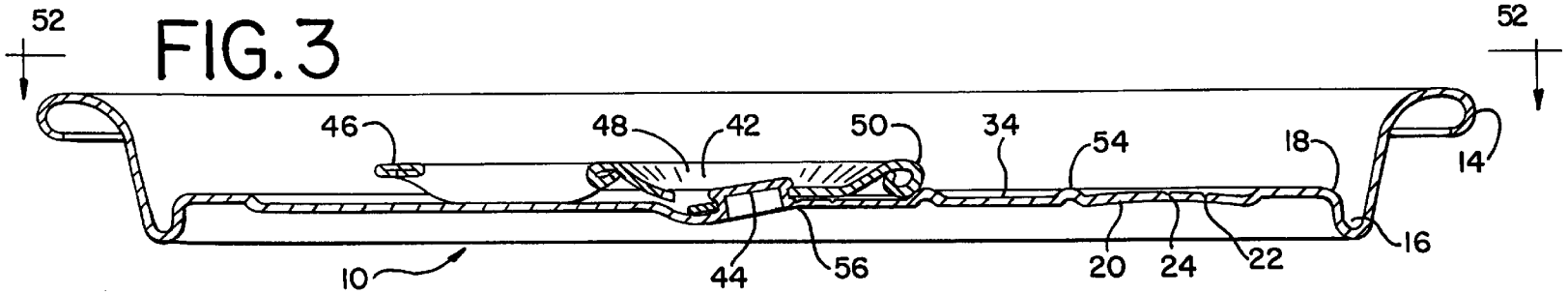
FIG. 3 is a cross-sectional view along 3—3 of FIG. 1.

In the preferred embodiment of FIGS. 1–3, the end closure 10 for a container (not shown) has a central panel wall 12 having a seaming curl 14 for joining the wall to the container. The container is typically a drawn and ironed metal can, usually constructed from a thin plate of aluminum or steel, such as the common beer and beverage containers. End closures for such containers are also typically constructed from a cutedge of thin plate of aluminum or steel, formed into blank end, and manufactured into a finished end by a process often referred to as end conversion. In the embodiment shown in the Figures, the central panel is joined to a container by a seaming curl 14 which is joined to a mating curl of the container. The seaming curl 14 of the end closure 10 is integral with the central panel 12 by a countersink area 16 which is joined to the panel outer edge 18 of the central panel 12. This type of means for joining the central panel 12 to a container is presently the typical means for joining used in the industry, and the structure described above is formed in the process of forming the blank end from a cutedge of metal plate, prior to the end conversion process. However, other means for joining the central panel 12 to a container may be employed with the present invention.

The central panel wall 12 has a displaceable tear panel 20 defined by a curvilinear frangible score 22 with an adjacent anti-fracture score 24 on the tear panel 20, and a non-frangible hinge segment 26. The hinge segment 26 is defined by a generally straight line between a first end 28 and a second end 30 of the frangible score 22. The tear panel 20 of the central panel 12 may be opened, that is the frangible score 22 may be severed and the tear panel 20 displaced at an angular orientation relative to the remaining portion of the central panel 12, while the tear panel 20 remains hingeably connected to the central panel 12 through the hinge segment 26. In this opening operation, the tear panel 20 is displaced at an angular deflection, as it is opened by being displaced away from the plane of the panel 12.

Figure 5:
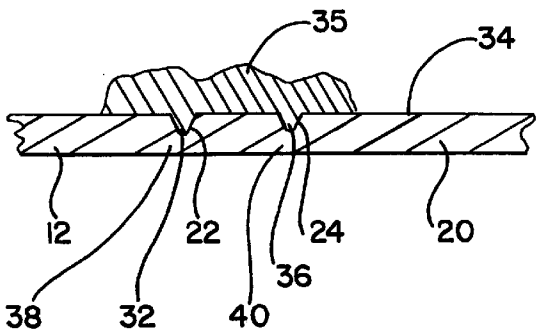
FIG. 5 is a cross-sectional view depicting the score and second groove of the present invention, with a partial sectional view depiction of the score tooling used to form the score and groove.

As best shown in FIG. 5, the frangible score 22 is preferably a generally V-shaped groove formed into the public side 34 of the panel wall 12. Similarly, the anti-fracture score 24, is preferably a generally V-shaped groove 36 formed into the public side 34 of the panel wall 12 on the tear panel 20. As is explained in more detail below, the score groove 32 is preferably deeper than the anti-fracture score groove 36. Accordingly, the score residual 38, being the amount of frangible material remaining below the score groove 32, is greater than the adjacent anti-fracture score residual 40. This difference between score residual 38 and adjacent anti-fracture score residual 40 is the score residual differential.

The score 22 and the second groove or anti-fracture score 24 are formed using conventional-type of scoring operation during the can end conversion process, using a tools that include an upper (public side) die with a score knife and a lower (product side) die with an anvil surface. As is partially shown in cross-section view in FIG. 5, the upper die 35 is applied to the public side 34 of the end wall 12 to form the V-shaped groove 32 of the score 22 and the V-shaped groove 36 of the second groove 24 on the tear panel 20.

The score residual differential is adapted to provide a tear panel 20 with a score 22 more readily frangible than the anti-fracture score 24, a significant factor for providing efficient opening of the end member 10. Having a double score comprised of a frangible score 22 and an anti-fracture score 24 wherein there is a score residual differential is common in the industry. The common types of end members have a differential maintained generally constant throughout the length of the score 22 and anti-fracture score 24. For example, if the score residual differential of commonly-used ends is set at approximately 0.002 inch, then that differential is maintained along the entire length of the double score, that is, along the entire length of the score 22 and the adjacent parallel area of the anti-fracture score 24. According to one aspect of the present invention, the score residual differential is reduced in a tail portion 25 of the anti-fracture score 24. This reduction of score residual differential at the tail portion 25 provides a tail segment of the anti-fracture score 24 that is more easily severed relative to the remaining regions of the anti-fracture score 24. In more general terms, the structure of the present invention is adapted to provide a tail portion of the inner score (the anti-fracture score) 24 that has a score residual 40 adapted to be severed. In the preferred embodiment of the invention the segment of the anti-fracture score that is adapted to be severed by having a reduced score residual differential is at least 0.050 inch in linear path length 80, and preferably in the range of 0.200 inch in linear path length 80 to fully direct any fracture in the hinge segment 26.

The stay-on-tab end member 10 has a tab 42 secured to the end panel 12 adjacent the tear panel 20 by a rivet 44. The tab has a lift end 46, a central region 48, and a nose portion 50. The lift end 46 and the nose portion 50 are generally aligned along a central longitudinal axis 52 of the end 10 passing through the rivet 44. A bead 54 is optionally formed in the tear panel 20 inward of the score 22 and the anti-fracture score 24. The tear panel bead 54 is useful to draw excess metal, or slack of metal, from the tear panel 20 to tighten the metal of the tear panel and improve opening characteristics of the end member 10 by the tab 42 being lifted to push against the ear panel 20.

During opening of the end member 10 by the user, the user lifts the lift end 46 of the tab 42 to displace the nose portion 50 downward against the tear panel 20. The force of the nose portion 50 against the tear panel 20 causes the score 22 to fracture, typically in a vent region 56 of the tear panel 20. As the tab displacement is continued, the fracture of the score 22 propagates around the tear panel 20, preferably in progression from the first end 28 of the score 22 toward the second end 30 of the score 22.

When the end member 10 has sustained damage, such as physical deformation often referred to as "buckle" due to dropping a filled container, then opening failure may result. The common buckle of an end is a bulge of the end panel wall 12, usually in the region of 5:00 to 7:00 (the central longitudinal axis 52 of the end 10 bing the 12:00 to 6:00 axis). This type of buckled end often results in an opening failure when the user tries to open the container tear panel 20. When the user lifts the lift end 46 of the tab 42 and the nose portion 50 is forced against the tear panel 20, the buckle in the end causes resistance to the propagation of the score 22 being severed in progression from the first end 28 toward the second end 30. The result is often that the hinge segment 26 severs, resulting in a fractured segment joining the first end 28 to the second end 30, and the tear panel 20 being held in place by a remaining segment of the frangible score 22 that has not yet fractured due to the buckle in the panel 12. Further, because the user continues to lift the tab 42 lift end 46 in attempt to open the tear panel 20, the nose 50 of the tab 42 is pushed downward into the container and back toward the rivet 44, such that the nose 50 goes beyond the tear panel 20 and is then in a position called "tuck under."

With prior art type ends, when the tab 42 is in tuck under position, the tab 42 is then useless for opening the tear panel 20. The user often then tries to open the tear panel 20 by pushing down on the tear panel 20 with his or her finger, or with some object. The force applied by the user results in completion of the fracture of the score 22, such that the tear panel is then fully severed, and is free of the panel wall 12, without attachment by the hinge segment 26. The structure of the present invention prevents such full separation of the tear panel 20 when the above-described conditions exist, by providing a ribbon of metal of the end wall 12, regardless of fracture of the hinge segment 26. With the present invention, the anti-fracture score 24 has a tail portion 25 that intersects the hinge segment 26. When the user pushes down on the tear panel 20 of the buckled end 10, and such force causes the hinge segment 26 to be severed, the fracture of the metal tends to follow the path of the tail portion 25 when the fracture propagation reaches the score groove 36 of the tail portion 25. The end result of the present invention being so opened, therefore, is that a ribbon 58 of material between the second end 30 of the score and the terminal end of the tail portion 60 of the tail portion 25. This ribbon 58 of material also includes the area between remaining area of the tail portion 25 and the adjacent parallel area of the score 22.

Figure 4:
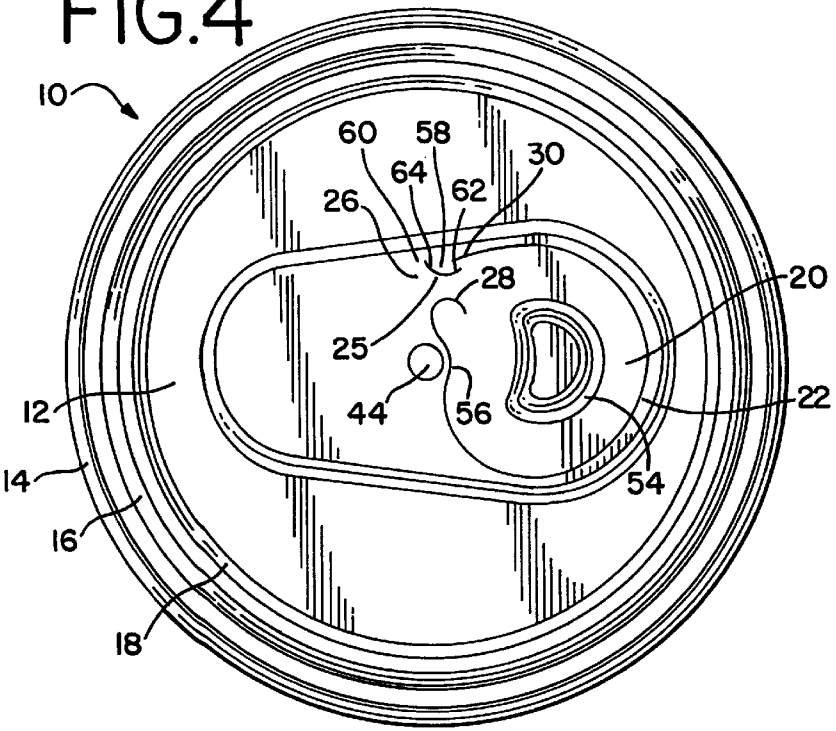
FIG. 4 is a plan view of the upper side of an end closure of an alternative embodiment of the present invention.

In alternative embodiments of the present invention, the tail portion 25 and/or the second end 30 of the score 22 vary in specific design or arrangements. Also, as an another alternative embodiment, the anti-fracture score 24 is absent except for the tail portion 25, as shown in FIG. 4. In this embodiment, the end member 10 has a panel wall 12 having a tear panel 20 defined by a frangible score 22 with a first end 28 and a second end 30, and a hinge segment 26 along a straight line between the ends of the score 22. The end 10 includes a score grove 62 that passes through the hinge segment 26, preferably generally transverse to the straight line defining the hinge segment 26. Much like the operation and structure described above regarding the anti-fracture score 24, the second groove is a groove into the panel wall 12 that has a groove depth and remaining residual. The residual in the tail portion of the second groove is preferably approximately the same as or only slightly less than the score residual 38 of the score 22. For example, in a preferred embodiment of this invention, the tail portion 64 of the second groove 62 has groove score residual that is approximately 0.000 to 0.002 inch greater than the score residual 38 at the adjacent area of the end of the score 22.

Figure 6:
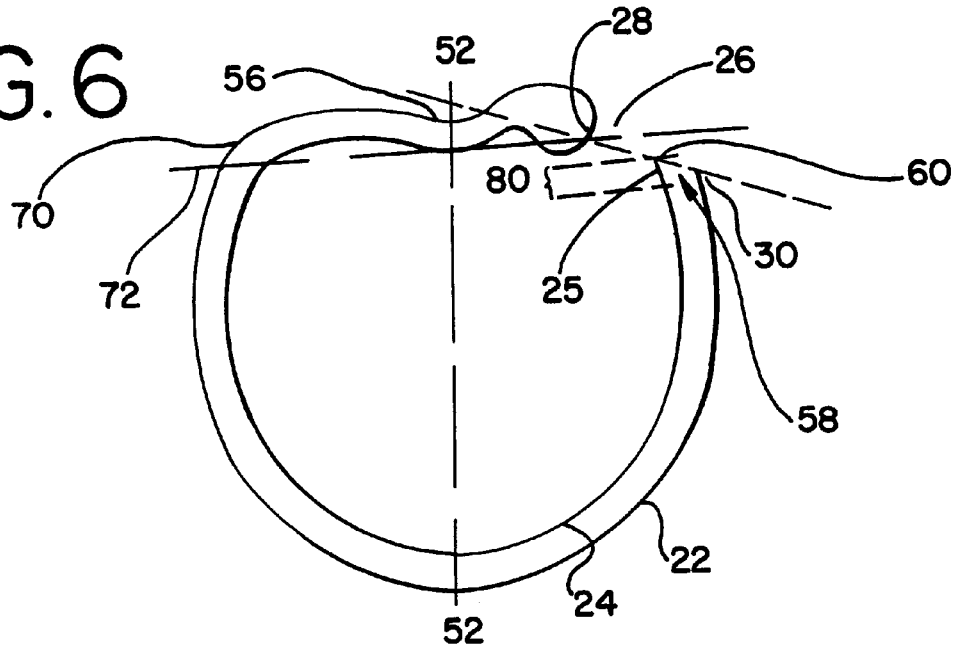
FIG. 6 is a plan view of the scoreline of an embodiment of the present invention.
Figure 7:
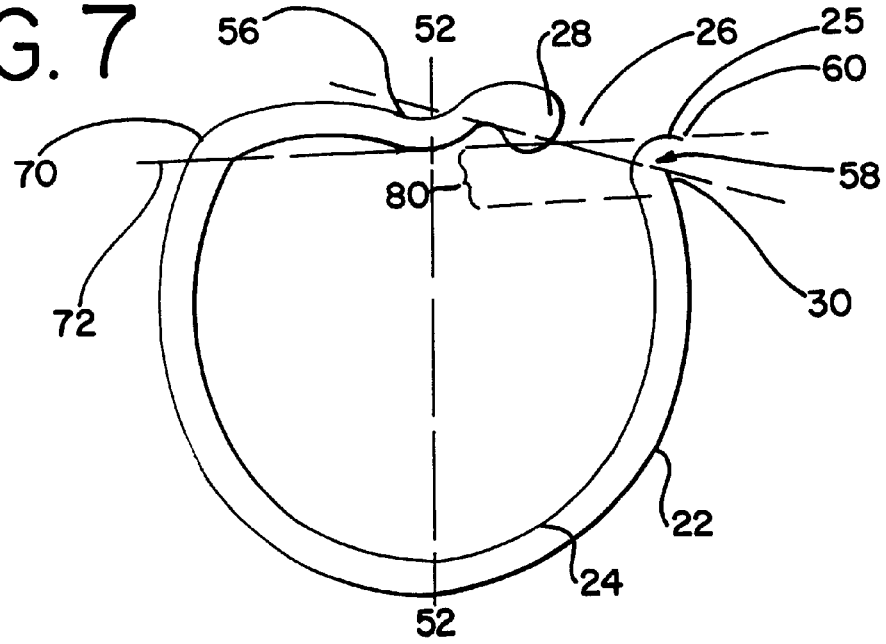
FIG. 7 is a plan view of the scoreline of an alternative embodiment of the present invention.

In the alternative embodiment of FIGS. 6 and 7, the score 22 and the anti-fracture score 24 follow a specific shape that is adapted to permit unrestricted deflection of the tab 42. In this embodiment, the curvilinear score 22 has a hip region 70 with a radius of curvature that is adapted to provide clearance for the tab 42 being deflected into the container. In the preferred embodiment, the radius of curvature of the hip region 70 is approximately 0.120 inch. Another preferred embodiment provides a score 22 wherein the hip region 70 is aligned with the score first end 28 along an transverse axis 72, that is a linear alignment 72 that is generally transverse to the central longitudinal axis 52 of the end member 10.

According to another aspect of an alternative embodiment of the invention as is best shown in FIGS. 6 and 7, the cord shape of the score 24 proximal to the second end 30, and the cord shape of the tail portion 25, may vary from that which is shown in FIGS. 1 and 2. In the alternative embodiment of FIG. 6, the tail portion 25 terminates in the end wall 12 beyond the score 22, and at least slightly transecting the line defining the hinge segment 26. Alternatively, the tail portion 25 extends further away from the tear panel 20 and curves away from the tab 42 and rivet 44 to at least partially surround the second end 30 of the score 22. This embodiment results in a tail portion 25 that not only transects the line defining the hinge segment 26, but also extends and encircles the second end 30 to transect arcuate or some other curvilinear path of a fracture through the hinge segment 26 between the first end 28 and the second end 30. Therefore, having the tail portion 25 at least partially surrounding the second end 30 ensures that the path of a fracture of the metal of the hinge segment 26 can avoid being transected by the tail portion 25. In another embodiment of the invention, the cord shape of the second end 30 of the score 22 shown in FIG. 7 may alternatively curve outward away from the tear panel 20.

In the preferred embodiment of the present invention, the tail portion 25 that transects the line defining the hinge segment 26 has a length adapted to direct a path of fracture in the metal of the hinge segment 26, directing the path of fracture along the cord shape of the tail portion 25. In the preferred embodiment, the length of the tail portion 25 is at least 0.050 inch, as measured in overall linear-path length shown as 80 in the Figures, and preferably having a length in the range of approximately 0.200 inch.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An end member for a container having a circumferential sidewall, the end member having a peripheral seaming edge adapted to be integrally connected to the sidewall, and having a central panel wall with a means for opening a frangible panel segment of the panel wall, the end member comprising;

a rivet formed in the central panel and adapted to integrally attach a tab lever to the panel, the tab having a nose portion overlying at least a vent region of the frangible panel segment and having a lift end opposite said nose;

a primary score groove in the central panel wall defining an outer perimeter of the frangible panel segment, the score groove having a first end adjacent the vent region, and a second end joined to the first end by a curvilinear segment of the score groove, the first end and the second end being separated by a generally linear hinge segment of the central panel wall, said hinge segment being non-frangible to integrally connect the frangible panel segment to an adjacent area of the panel; and, a second score groove having a tail portion passing from the frangible panel into said adjacent area of the central panel and transecting said hinge segment.

2. The end member of claim 1, wherein, the second score groove has a curvilinear segment generally parallel an extent of the primary score groove, said curvilinear segment being positioned on the frangible panel radially inward of the outer perimeter.

3. The end member of claim 1, wherein, at least a terminal length of the second score groove curves to a direction away from said first end of the primary score.

4. The end member of claim 1, wherein, the tail of the second score groove passes through the hinge line generally transverse to a hinge line passing between the first end and the second end of the primary score groove.

5. The end member of claim 1, wherein, said second end of the score groove curves away from an adjacent segment of said second groove.

6. The end member of claim 1, wherein, the primary score groove has a score residual of the central panel wall, and said second score groove has a groove residual of the central panel wall, the primary score residual being less than the second score groove residual along said tail portion.

7. The end member of claim 6, wherein, the primary score residual of said second end is in the range of 0.003 to 0.005 inches, and the second score groove residual along the tail portion is between 0.001 to 0.002 inch greater than the score residual of said second end.

8. The end member of claim 1, wherein, the tail portion of the second score groove end extends into said adjacent area of the central panel and partially surrounds the second end of the primary score groove.

9. The end member of claim 8, wherein, the tail portion has a curvilinear end extending generally away from the first end of the primary score groove to partially surround said second end of the primary score groove.

10. The end member of claim 1, wherein, the primary score groove and the second score groove together form a double scoreline, the double scoreline being separated at the second end of the primary score groove and said tail portion of the second score groove extending longer than said primary score groove second end.

11. The end member of claim 10, wherein, the primary score groove has a score residual at terminal region of said second end and the second score groove has a groove residual at the tail portion, the groove residual of the second score being less than 0.002 inch greater than said score residual of said terminal region of the primary score.

12. The end member of claim 11, wherein, the tail of the second score groove tail portion is approximately 0.020 inches in length.

13. An end member for a container having a circumferential sidewall, the end member having a peripheral seaming edge adapted to be integrally connected to the sidewall, and having a central panel wall, the end member comprising;

a frangible panel formed in the panel wall and being defined by a curvilinear score groove and a hinge segment, the score groove having a thickness residual and having a first end and a second end, said hinge segment having a length defined by a generally straight line between said first end and said second end;

a rivet formed in the central panel and adapted to integrally attach a tab lever to the panel, the tab having a nose portion overlying at least a region of the frangible panel segment and having a lift end opposite said nose; and, a curvilinear anti-fracture score formed in the frangible panel generally parallel to said score groove, said anti-fracture score having a tail portion passing through the hinge segment.

14. The end member of claim 13, wherein, the tail portion passes through the hinge segment generally transverse to said straight line between the first and second end.

15. The end member of claim 13, wherein the anti-fracture groove has a thickness residual greater than said score groove thickness residual, said greater thickness defining a thickness residual differential between said score groove and said anti-fracture score, said thickness differential being reduced along the tail portion of said anti-fracture score.

16. The end member of claim 15, wherein said residual differential along an extent of said score groove is approximately 0.002 inch, and said residual differential being approximately 0.001 inch along said tail portion of the anti-fracture groove.

17. The end member of claim 16, wherein, the tail portion is at least 0.050 inch in length.

18. The end member of claim 13 wherein, said curvilinear score groove has a first segment leading from said first end to a hip region of said score groove, said first segment passing under a nose portion of said tab and said hip region having a radius of curvature adapted to permit unobstructed passage of the tab when a user lifts the tab to open the frangible tear panel.

19. The end member of claim 18 wherein, the radius of curvature of said hip region is approximately 0.120 inch.

20. The end member of claim 18 wherein, the end member has a central longitudinal axis, the hip region and said first end of the score groove being generally aligned along a transverse axis relative to said central longitudinal axis.

21. An end member for a container, the end member having a central panel wall adapted to be secured to the container at the outer edge of the end member, the end member comprising;

a frangible panel formed in the panel wall and at least partially defined by a score groove with a first end and a second end, wherein the score groove at the second end is curved outward toward the outer edge of the panel;

a hinge line passing between the first and second end of the score groove; and, a second score groove in the panel wall and transecting the hinge line.

22. The end member of claim 21, wherein the second score groove is an anti-fracture score with an extended end passing through the hinge line.

23. The end member of claim 21, wherein the second score groove has a terminal end curved outward toward the outer edge of the panel.

* * * * *